US012427393B1

(12) United States Patent
Shi

(10) Patent No.: US 12,427,393 B1
(45) Date of Patent: Sep. 30, 2025

(54) GOLF TRAINING AID

(71) Applicant: Xiaojin Shi, Shenzhen (CN)

(72) Inventor: Xiaojin Shi, Shenzhen (CN)

( * ) Notice: Subject to any disclaimer, the term of this patent is extended or adjusted under 35 U.S.C. 154(b) by 0 days.

(21) Appl. No.: 19/078,362

(22) Filed: Mar. 13, 2025

(51) Int. Cl.
*A63B 69/36* (2006.01)
*A63B 63/00* (2006.01)
*A63B 67/02* (2006.01)

(52) U.S. Cl.
CPC ..... *A63B 69/3676* (2013.01); *A63B 63/00* (2013.01); *A63B 67/02* (2013.01); *A63B 2063/001* (2013.01)

(58) Field of Classification Search
CPC ..... A63B 69/3676; A63B 63/00; A63B 67/02; A63B 2063/001
See application file for complete search history.

(56) References Cited

U.S. PATENT DOCUMENTS

2025/0083015 A1* 3/2025 Jones ..... A63B 71/0669

* cited by examiner

*Primary Examiner* — Jeffrey S Vanderveen
(74) *Attorney, Agent, or Firm* — Nicholas Makridakis

(57) ABSTRACT

A golf training aid is provided, including a main base, a ball roll-out track, and a plurality of goal baffles. The main base is provided with an installing groove and a slope guiding slot, the slope guiding slot is configured to extend around a rear and along one side of the installing groove, and the slope guiding slot is connected to the installing groove. The goal baffles are arranged side by side with each goal baffle is disposed and flipped up and down in the installing groove, the goal baffle extends forward and backward, and the goal baffle is provided with a goal guiding slot extending forward and backward. There is no need to pick up the ball, and it is also suitable for multiplayer games, making it easier to develop more game rules for playing the game and also effectively increasing the fun and convenience of the game.

9 Claims, 5 Drawing Sheets

GOLF TRAINING AID

TECHNICAL FIELD

The present application relates to the technical field of ball training aids, and in particular to a golf training aid.

BACKGROUND

Golf training aid is a device or equipment that assists golfers in training. The golf training aid has a variety of designs and features, which aims to help players improve their golf skills, including areas such as swing techniques, accuracy, force control, and mentality. Thus, the golf training aid is one of very useful tools that may help the golfers improve their golf skills. Both beginners and experienced players may improve their swing accuracy, strength, and consistency by using the golf training aid.

Currently, the golf training aid only has one goal mouth, resulting in the goal scoring is relatively single and not suitable for multiplayer games, which lacks fun and difficulty of the goal scoring is high, making it less suitable for beginners. Therefore, it is necessary to improve the current golf training aids.

SUMMARY

In view of the shortcomings of existing technologies, the present disclosure aims to provide a golf training aid to effectively address the problems of difficulty in goal scoring and low interest of the current golf training aids.

To achieve above objectives, the present disclosure adopts the following technical solutions.

In some embodiments of the present disclosure, a golf training aid is provided, including a main base, a ball roll-out track, and a plurality of goal baffles. Herein the main base is provided with an installing groove and a slope guiding slot, the slope guiding slot is configured to extend around a rear and along one side of the installing groove, and the slope guiding slot is connected to the installing groove. The ball roll-out track is configured to connect with an outgoing end of the slope guiding slot and extend forward. The goal baffles are arranged side by side with each goal baffle is disposed and flipped up and down in the installing groove, the goal baffle extends forward and backward, and the goal baffle is provided with a goal guiding slot extending forward and backward.

In some preferred embodiments of the present disclosure, a fixed shaft is provided in a middle of the installing groove, the fixed shaft is configured to extend left and right, and middles of the goal baffles are hinged with the fixed shaft.

In some preferred embodiments of the present disclosure, inner walls on both sides of the installing groove are provided with slots, and both ends of the fixed shaft are inserted into corresponding slots from top to bottom respectively.

In some preferred embodiments of the present disclosure, the middles of the goal baffles are provided with shaft holes, the fixed shaft is passed through the shaft holes, and bearings are sandwiched between the fixed shaft and the shaft holes.

In some preferred embodiments of the present disclosure, counterweights are provided on a front bottom and a rear bottom of the goal baffle.

In some preferred embodiments of the present disclosure, a rear top of the main base is provided with a barrier plate located above a rear of the slope guiding slot, and the barrier plate has a height higher than a height of the goal baffle.

In some preferred embodiments of the present disclosure, the ball roll-out track includes a plurality of splicing segments, and the splicing segments are detachably spliced together from front to back.

In some preferred embodiments of the present disclosure, one splicing segment located at a backmost of the splicing segments is detachably spliced together with the main base.

In some preferred embodiments of the present disclosure, another splicing segment located at a forefront of the splicing segments is provided with an output port bending inward.

In some preferred embodiments of the present disclosure, the goal baffles consists of four adjacent goal baffles arranged side by side.

Compared with the existing technologies, the golf training aid of the present disclosure has significant advantages and beneficial effects. Specifically, the following advantages can be seen from the above technical solutions.

By setting the plurality of goal baffles that can be flipped up and down in the installing groove, so that multipath goals can be scored. After the golf ball enters, rear ends of the goal baffles automatically flips downward, and the golf ball enters the ball roll-out track along the slope guiding slot and then automatically rolls out along the ball roll-out track. There is no need to pick up the ball, and it is also suitable for multiplayer games, making it easier to develop more game rules for playing the game and also effectively increasing the fun and convenience of the game. The experience is stronger, and the difficulty of goal scoring is small, making it very suitable for beginners to use.

Figure 1:
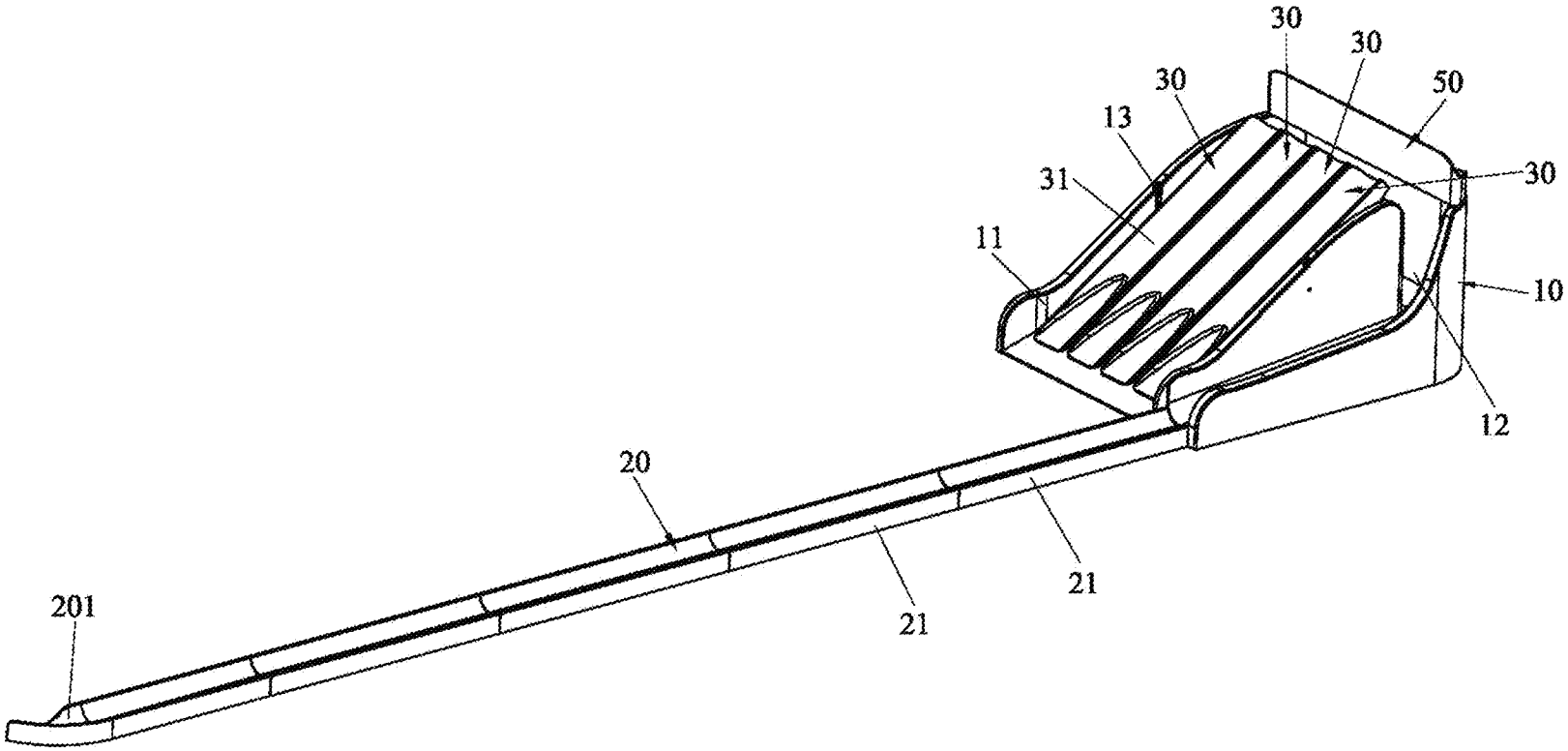
FIG. 1 shows an assembled stereoscopic schematic diagram of a golf training aid in accordance with some preferred embodiments of the present disclosure.

In the drawings, reference signs are as follows.

| | | | |
|---|---|---|---|
| 10 | Main base | 11 | Installing groove |
| 12 | Slope guiding slot | 13 | slot |
| 20 | Ball roll-out track | 21 | Splicing segment |
| 201 | Output port | 30 | Goal baffle |
| 31 | Goal guiding slot | 32 | Shaft hole |
| 33 | counterweight | 41 | Fixed shaft |
| 42 | bearing | 50 | Barrier plate |

DETAILED DESCRIPTION OF THE EMBODIMENTS

Figure 2:
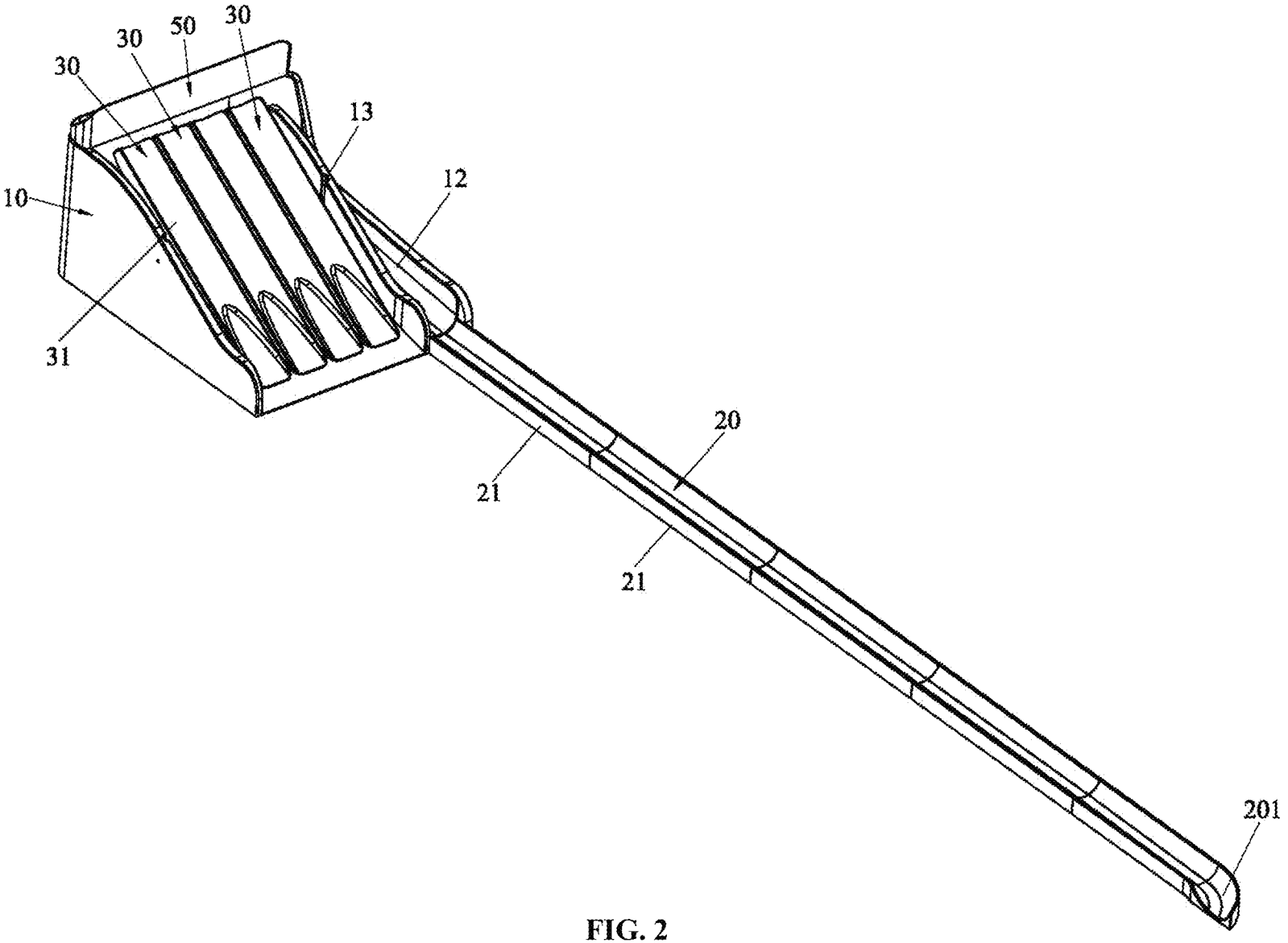
FIG. 2 shows another assembled stereoscopic schematic diagram from the other perspective of the golf training aid in accordance with some preferred embodiments of the present disclosure.
Figure 3:
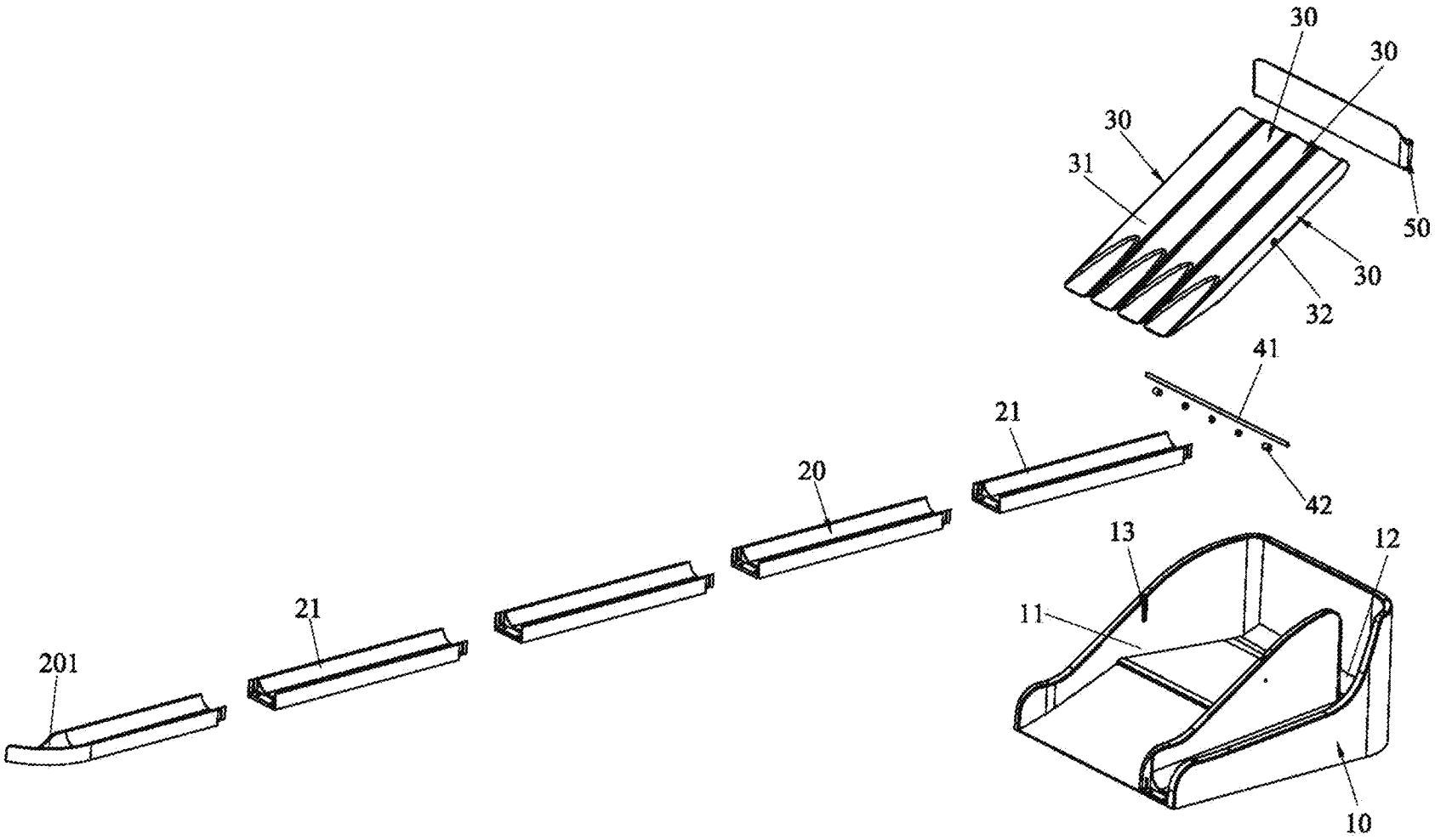
FIG. 3 shows an exploded view of the golf training aid in accordance with some preferred embodiments of the present disclosure.
Figure 4:
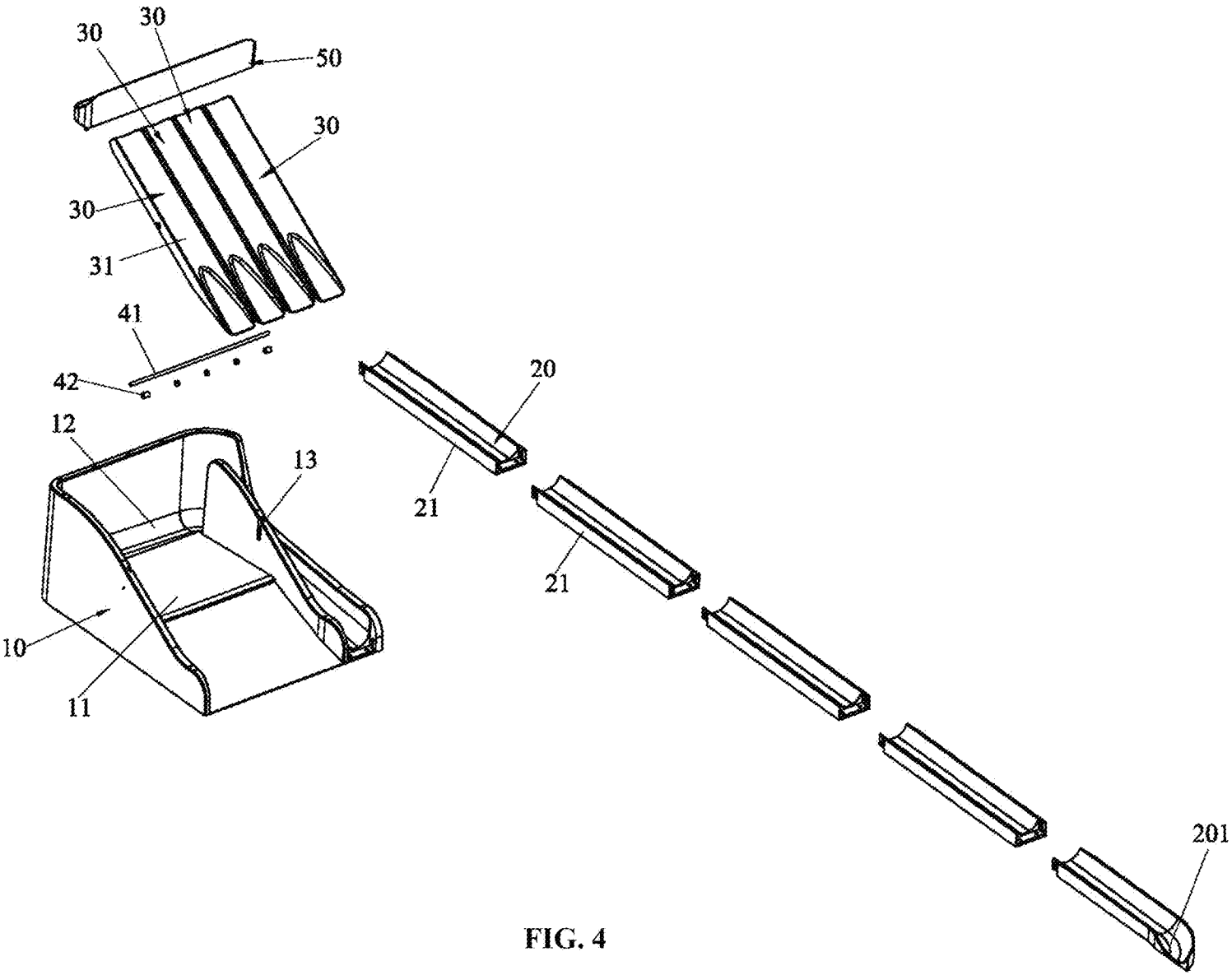
FIG. 4 shows another exploded view from the other perspective of the golf training aid in accordance with some preferred embodiments of the present disclosure.
Figure 5:
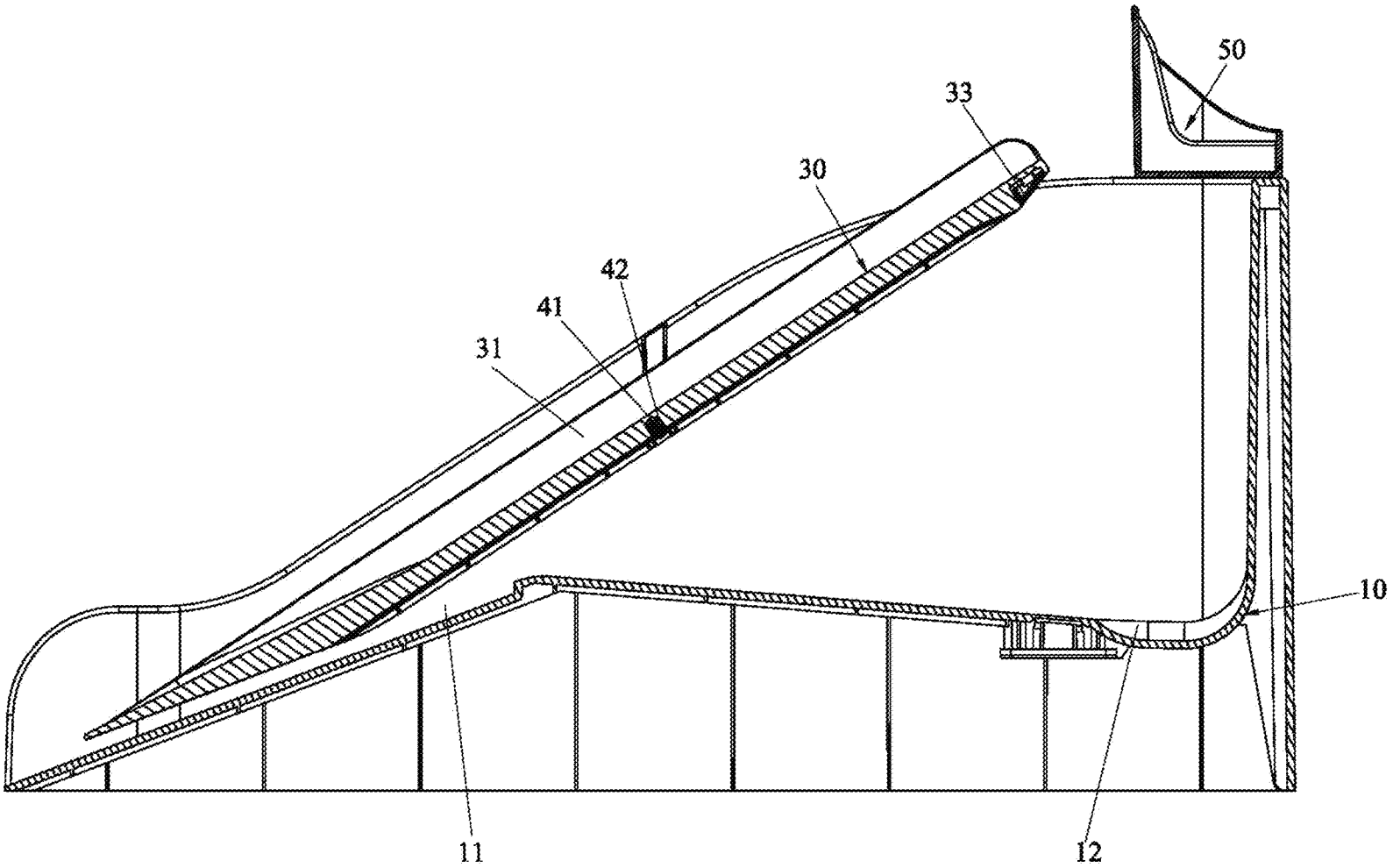
FIG. 5 shows a sectional view of the golf training aid in accordance with some preferred embodiments of the present disclosure.

As shown in FIG. 1 to FIG. 5, which illustrate the specific structure of a golf training aid in accordance with some preferred embodiments of the present disclosure, including a main base 10, a ball rout-out track 20, and a plurality of goal baffles 30.

The main base 10 is provided with an installing groove 11 and a slope guiding slot 12, the slope guiding slot 12 is configured to extend around a rear and one side of the installing groove 11, and the slope guiding slot 12 is connected to the installing groove 11. In some embodiments of the present disclosure, a fixed shaft 41 is provided in a middle of the installing groove 11, and the fixed shaft 41 is configured to extend left and right. Furthermore, inner walls on both sides of the installing groove are provided with slots 13, and both ends of the fixed shaft 41 are inserted into corresponding slots 13 from top to bottom respectively. By such designs, the structure is simple and easy to disassemble and assemble. Moreover, a rear top of the main base 10 is provided with a barrier plate 50 located above a rear of the slope guiding slot 12, and the barrier plate 50 has a height higher than a height of the goal baffle 30.

The ball roll-out track 20 is connected to an outgoing end of the slope guiding slot 12 and extends forward. In some embodiments of the present disclosure, the ball roll-out track 20 includes a plurality of splicing segments 21, and the splicing segments 21 are detachably spliced together from front to back. Furthermore, one splicing segment 21 located at the backmost of the splicing segments 21 is detachably spliced together with the main base 10, and the other splicing segment 21 located at the forefront of the splicing segments 21 is provided with an output port 201 bending inward to guide the golf ball directly to the tec.

The plurality of goal baffles 30 are arranged side by side with each goal baffle 30 can be disposed in the installing groove 11 and flipped up and down, the each goal baffle 30 extends forward and backward, and the each goal baffle 30 is provided with a goal guiding slot 31 extending forward and backward. In some embodiments of the present disclosure, middles of the goal baffles 30 are hinged with the fixed shaft 41. Furthermore, the middles of the goal baffles 30 are provided with shaft holes 32, the fixed shaft 41 is passed through the shaft holes 32, and bearings 42 are sandwiched between the fixed shaft 41 and the shaft holes 32 to ensure smooth flipping of the goal baffles 30. Moreover, counterweights 33 are provided on a front bottom and a rear bottom of the each goal baffle 30 to prevent unstable shaking during use. In addition, the goal baffles 30 consists of four adjacent goal baffles 30 arranged side by side, but the quantity is not limited herein, which may be added or removed as needed.

The operation method of the golf training aid of the present disclosure is described in detailed below.

When in use, place the golf ball in a location in front of the goal baffles 30 and near the output port 201, and then hit the golf ball to enter the goal guiding slot 31 of one of the goal baffles 30. When the golf ball rolls along the goal guiding slot to the rear end of the goal baffles 30, its gravity causes the goal baffles 30 to flip downwards. After entering, the golf ball can keep the lower ends of the goal baffles 30 facing downwards without shaking, so that the golf ball falls into the slope guiding slot 12. Next, the golf ball enters the ball roll-out track 20 along the slope guiding slot 12, and finally rolls along the ball roll-out track 20 to the tec. Then, hit the golf ball again to enter the goal guiding slot 31 of another goal baffle 30 or hit the rear end of the flipped goal baffle 30, causing the front end of the flipped goal baffle 30 to flip down and reset. Then the golf ball enters the slope guiding slot 12 and enters the ball roll-out track 20 along the slop guiding slot 12. Finally, the golf ball rolls along the ball roll-out track 20 to the tee. This can be repeated cyclic operations, making the golf hitting training can be continuously performed.

The design of the golf training aid of the present disclosure is emphasis on that, by setting the plurality of goal baffles that can be flipped up and down in the installing groove, so that multipath goals can be scored. After the golf ball enters, rear ends of the goal baffles automatically flips downward, and the golf ball enters the ball roll-out track along the slope guiding slot and then automatically rolls out along the ball roll-out track. There is no need to pick up the ball, and it is also suitable for multiplayer games, making it easier to develop more game rules for playing the game and also effectively increasing the fun and convenience of the game. The experience is stronger, and the difficulty of goal scoring is small, making it very suitable for beginners to use.

The technical principles of the golf training aid of the present disclosure have been described above in conjunction with specific embodiments. These descriptions are only intended to explain the principles of the golf training aid of the present disclosure and cannot be interpreted in any way as limiting the scope of protection of the present disclosure. Based on the explanation herein, other specific embodiments that can be associated by one of ordinary skill in the art without creative labor shall fall within the scope of protection of the present invention.

What is claimed is:

1. A golf training aid, comprising a main base, a ball roll-out track, and a plurality of goal baffles;

wherein the main base is provided with an installing groove and a slope guiding slot, the slope guiding slot is configured to extend around a rear and along one side of the installing groove, and the slope guiding slot is connected to the installing groove;

wherein the ball roll-out track is configured to connect with an outgoing end of the slope guiding slot and extend forward;

wherein the goal baffles are arranged side by side with each goal baffle is disposed and flipped up and down in the installing groove, the goal baffle extends forward and backward, and the goal baffle is provided with a goal guiding slot extending forward and backward; and wherein a fixed shaft is provided in a middle of the installing groove, the fixed shaft is configured to extend left and right, and middles of the goal baffles are hinged with the fixed shaft.

2. The golf training aid according to claim 1, wherein inner walls on both sides of the installing groove are provided with slots, and both ends of the fixed shaft are inserted into corresponding slots from top to bottom respectively.

3. The golf training aid according to claim 1, wherein the middles of the goal baffles are provided with shaft holes, the fixed shaft is passed through the shaft holes, and bearings are sandwiched between the fixed shaft and the shaft holes.

4. The golf training aid according to claim 1, wherein counterweights are provided on a front bottom and a rear bottom of the goal baffle.

5. The golf training aid according to claim 1, wherein a rear top of the main base is provided with a barrier plate located above a rear of the slope guiding slot, and the barrier plate has a height higher than a height of the goal baffle.

6. The golf training aid according to claim 1, wherein the ball roll-out track comprises a plurality of splicing segments, and the splicing segments are detachably spliced together from front to back.

7. The golf training aid according to claim 6, wherein one splicing segment located at a backmost of the splicing segments is detachably spliced together with the main base.

8. The golf training aid according to claim 6, wherein another splicing segment located at a forefront of the splicing segments is provided with an output port bending inward.

9. The golf training aid according to claim 1, wherein the goal baffles consists of four adjacent goal baffles arranged side by side.

* * * * *